US008423356B2

(12) United States Patent
Breebaart et al.

(10) Patent No.: US 8,423,356 B2
(45) Date of Patent: Apr. 16, 2013

(54) METHOD OF DERIVING A SET OF FEATURES FOR AN AUDIO INPUT SIGNAL

(75) Inventors: Dirk Jeroen Breebaart, Eindhoven (NL); Martin Franciscus McKinney, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1189 days.

(21) Appl. No.: 12/090,362

(22) PCT Filed: Oct. 16, 2006

(86) PCT No.: PCT/IB2006/053787

§ 371 (c)(1),
(2), (4) Date: Apr. 16, 2008

(87) PCT Pub. No.: WO2007/046048

PCT Pub. Date: Apr. 26, 2007

(65) Prior Publication Data

US 2008/0281590 A1 Nov. 13, 2008

(30) Foreign Application Priority Data

Oct. 17, 2005 (EP) ..... 05109648

(51) Int. Cl.
*G10L 19/00* (2006.01)
*G10L 11/04* (2006.01)
*G10L 11/00* (2006.01)

(52) U.S. Cl.
USPC ..... 704/216; 704/206; 704/218; 704/270

(58) Field of Classification Search ..... None
See application file for complete search history.

(56) References Cited

U.S. PATENT DOCUMENTS 5,918,223 A 6/1999 Blum et al.
6,469,240 B2 * 10/2002 Pachet et al. ..... 84/635
(Continued)

FOREIGN PATENT DOCUMENTS

WO WO9827543 A2 6/1988
WO WO8810540 A1 12/1988
(Continued)

OTHER PUBLICATIONS

J. P. Lewis, "Fast Template Matching", Vision Interface, p. 120-123, 1995.*
Pikrakis et al., "Recognition of Isolated Musical Patterns Using Context Dependent Dynamic Time Warping", IEEE Transactions on Speech and Audio Processing, vol. 11, No. 3, May 2003.*
(Continued)

*Primary Examiner* — Brian Albertalli

(57) ABSTRACT

The invention describes a method of deriving a set of features (S) of an audio input signal (M), which method comprises identifying a number of first-order features ($f_1, f_2, \ldots, f_f$) of the audio input signal (M), generating a number of correlation values ($\rho_1, \rho_2, \ldots, \rho_I$) from at least part of the first-order features ($f_1, f_2, \ldots, f_f$), and compiling the set of features (S) for the audio input signal (M) using the correlation values ($\rho_1, \rho_2, \ldots, \rho_I$). The invention further describes a method of classifying an audio input signal (M) into a group, and a method of comparing audio input signals (M, M') to determine a degree of similarity between the audio input signals (M, M'). The invention also describes a system (1) for deriving a set of features (S) of an audio input signal (M), a classifying system (4) for classifying an audio input signal (M) into a group, and a comparison system (5) for comparing audio input signals (M, M') to determine a degree of similarity between the audio input signals (M, M').

10 Claims, 4 Drawing Sheets

U.S. PATENT DOCUMENTS

| | | | | |
|---|---|---|---|---|
| 6,542,869 | B1 * | 4/2003 | Foote | 704/500 |
| 6,804,643 | B1 | 10/2004 | Kiss | |
| 6,957,183 | B2 * | 10/2005 | Malayath et al. | 704/246 |
| 7,082,394 | B2 * | 7/2006 | Burges et al. | 704/243 |
| 7,232,948 | B2 * | 6/2007 | Zhang | 84/600 |
| 7,412,384 | B2 * | 8/2008 | Kondo et al. | 704/237 |
| 7,565,213 | B2 * | 7/2009 | Dittmar et al. | 700/94 |
| 8,311,821 | B2 * | 11/2012 | Breebaart et al. | 704/234 |
| 2002/0088336 | A1 * | 7/2002 | Stahl | 84/609 |
| 2002/0152069 | A1 | 10/2002 | Gao et al. | |
| 2004/0059570 | A1 * | 3/2004 | Mochinaga et al. | 704/205 |
| 2006/0196337 | A1 * | 9/2006 | Breebart et al. | 84/1 |

FOREIGN PATENT DOCUMENTS

| | | | |
|---|---|---|---|
| WO | WO9422132 | A1 | 9/1994 |
| WO | WO0120609 | A2 | 3/2001 |

OTHER PUBLICATIONS

Gao et al., "A Hidden Markov Model Based Approach to Music Segmentation and Identification", ICICS-PCM 2003.*

Chollet et al: On the Evaluation of Speech Recognizers and Data Bases; Acoustics, Speech and Signal Processing, IEEE International Conference on ICASSP 1982, vol. 7, May 1982, pp. 2026-2029.

Tzanetakis et al: "Musical Genre Classification of Audio Signals"; IEEE Transactions on Speech and Audio Processing, vol. 10, No. 5, Jul. 2002, pp. 293-302.

Shih et al: "An HMM-Based Approach to Humming Transcription"; 2002 IEEE, pp. 337-340.

Ahrendt et al: "Decision Time Horizon for Music Genre Classification Usisng Short Time Features"; Informatics and Mathematical Modelling, Technical University of Denmark, 4 Page Document.

* cited by examiner

METHOD OF DERIVING A SET OF FEATURES FOR AN AUDIO INPUT SIGNAL

This invention relates to a method of deriving a set of features of an audio input signal, and to a system for deriving a set of features of an audio input signal. The invention also relates to a method of and system for classifying an audio input signal, and to a method of and system for comparing audio input signals.

Storage capabilities for digital content are increasing dramatically. Hard disks with at least one terabyte of storage capacity are expected to be available in the near future. Added to this, the evolution of compression algorithms for multimedia content, such as the MPEG standard, considerably reduces the amount of required storage capacity per audio or video file. The result is that consumers will be able to store many hours of video and audio content on a single hard disk or other storage medium. Video and audio can be recorded from an ever-increasing number of radio and TV stations. A consumer can easily augment his collection by simply downloading video and audio content from the world-wide-web, a facility which is becoming more and more popular. Furthermore, portable music players with large storage capacities are affordable and practical, allowing a user to have access, at any time, to a wide selection of music from which to choose.

The huge selection of video and audio data available from which to choose is not without problems, however. For example, organization and selection of music from a large music database, with thousands of music tracks, is difficult and time-consuming. The problem can be addressed in part by the inclusion of metadata, which can be understood to be an additional information tag attached in some way to the actual audio data file. Metadata is sometimes provided for an audio file, but this is not always the case. When faced with a time-consuming and irritating retrieval and classification problem, a user might most likely give up, or not bother at all.

Some attempts have been made in addressing the problem of classification of music signals. For example, WO 01/20609 A2 suggests a classification system in which audio signals, i.e. pieces of music or music tracks, are classified according to certain features or variables such as rhythm complexity, articulation, attack, etc. Each piece of music is assigned weighted values for a number of chosen variables, depending on the extent to which each variable applies to that piece of music. However, such a system has the disadvantage that the level of accuracy in classification or comparison of music tracks similar pieces of music is not particularly high.

Therefore, an object of the present invention is to provide a more robust and accurate way of characterising, classifying or comparing audio signals.

To this end, the present invention provides a method of deriving a set of features of an audio input signal, particularly for use in classification of the audio input signal and/or comparison of the audio input signal with another audio signal and/or characterization of the audio input signal, which method comprises identifying a number of first-order features of the audio input signal, generating a number of correlation values from at least part of the first-order features, and compiling the set of features for the audio input signal using the correlation values. The step of identifying may comprise, for example, extracting a number of first-order features from the audio input signal or retrieving a number of first-order features from a database.

The first-order features are certain chosen descriptive characteristics of an audio input signal, and might describe signal bandwidth, zero-crossing rate, signal loudness, signal brightness, signal energy or power spectral value, etc. Other qualities described by first-order features might be spectral roll-off frequency, spectral centroid etc. The first-order features derived from the audio input signal might be chosen to be essentially orthogonal, i.e. they might be chosen to be independent from each other to a certain degree. A sequence of first-order features can be put together into what is generally referred to as a "feature vector", where a certain position in a feature vector is always occupied by the same type of feature.

The correlation value generated from a selection of the first-order features, and therefore also referred to as a second-order feature, describes the inter-dependence or co-variance between these first-order features, and is a powerful descriptor for an audio input signal. It has been shown that often, with the aid of such second-order features, music tracks can accurately be compared, classified or characterised, where first-order features would be insufficient.

An obvious advantage of the method according to the invention is that a powerful descriptive set of features can easily be derived for any audio input signal, and this set of features can be used, for example, to accurately classify the audio input signal, or to quickly and accurately identify another similar audio signal. For example, a preferred set of features compiled for an audio signal, comprising elements of the first-order and second-order features, does not only describe certain chosen descriptive characteristics, but also describes the interrelationship between these chosen descriptive characteristics.

An appropriate system for deriving a set of features of an audio input signal comprises a feature identification unit for identifying a number of first-order features of the audio input signal, a correlation value generation unit for generating a number of correlation values from at least part of the first-order features, and a feature set compilation unit for compiling a set of features for the audio input signal using the correlation values. The feature identification unit may comprise, for example, a feature extraction unit and/or a feature retrieval unit.

The dependent claims and the subsequent description disclose particularly advantageous embodiments and features of the invention.

The audio input signal can originate from any suitable source. Most generally, an audio signal might originate from an audio file, which may have any one of a number of formats. Examples of audio file formats are uncompressed, e.g. (WAV), lossless compressed, e.g. Windows Media Audio (WMA), and lossy compressed formats such as MP3 (MPEG-1 Audio Layer 3) file, AAC (Advanced Audio Codec), etc. Equally, the audio input signal can be obtained by digitising an audio signal using any suitable technique, which will be known to a person skilled in the art.

In the method according to the invention, the first-order features (sometimes also referred to as observations) for the audio input signal might preferably be extracted from one or more sections in a given domain, and generation of a correlation value preferably comprises performing a correlation using pairs of the first-order features of corresponding sections in the appropriate domain. A section can be, for example, a time-frame or segment in the time domain, where a "time-frame" is simply a range of time covering a number of audio input samples. A section can also be a frequency band in the frequency domain, or a time/frequency "tile" in a filter-bank domain. These time/frequency tiles, time-frames and frequency bands are generally of uniform size or duration. A feature associated with a section of the audio signal can hence be expressed as a function of time, as a function of frequency, or as a combination of both, so that correlations can be performed for such features in one or both domains. In the following, the terms "section" and "tile" are used interchangeably.

In a further preferred embodiment of the invention, generation of a correlation value for first-order features extracted from different, preferably neighbouring, time-frames comprises performing a correlation using first-order features of these time-frames, so that the correlation value describes the interrelationship between these neighbouring features.

In one preferred embodiment of the invention, a first-order feature is extracted in the time domain for each time-frame of the audio input signal, and a correlation value is generated by performing a cross-correlation between a pair of features over a number of consecutive feature vectors, preferably over the entire range of feature vectors.

In an alternative preferred embodiment of the invention, a first-order feature is extracted in the frequency domain for each time-frame of the audio input signal, and a correlation value is computed by performing a cross correlation between certain features of the feature vectors of two time-frames over frequency bands of the frequency domain, where the two time-frames are preferably, but not necessarily, neighbouring time-frames. In other words, for each time-frame of a plurality of time-frames, at least two first-order features are extracted for at least two frequency bands, and generation of a correlation value comprises performing a cross-correlation between of the two features over time-frames and frequency band.

The first-order features of a feature vector, since chosen to be independent or orthogonal from each other, will be features describing different aspects of the audio input signal, and will therefore be expressed in different units. To compare levels of co-variance between different variables of a collection of variables, each variable's mean deviation can be divided by its standard deviation, in a commonly known technique used to calculate the product-moment correlation or cross-correlation between two variables. Therefore, in a particularly preferred embodiment of the invention, a first-order feature used in generating a correlation value is adjusted by subtracting from it the mean or average of all appropriate features. For example, when computing a correlation value for two time-domain first-order features across the entire range of feature vectors, the mean of each of the first-order features is first computed and subtracted from the values of the first-order features before calculating a measure for the variability of a feature, such as mean deviations and standard deviations. Similarly, when computing a correlation value for two frequency-domain features from two neighbouring feature vectors, the mean of the first-order features across each of the two feature vectors is first calculated and subtracted from each first-order feature of the respective feature vector before computing the product-moment correlation or cross-correlation for the two chosen first-order features.

A number of such correlation values can be calculated, for example a correlation value each for the first & second, first & third, second & third first-order features, and so on. These correlation values, which are values describing the co-variance or interdependency between pairs of features for the audio input signal, might be combined to give a collective set of features for the audio input signal. To increase the information content of the set of features, the set of features preferably also comprises some information directly regarding the first-order features, i.e. appropriate derivatives of the first-order features such as mean or average values for each of the first-order features, taken across the range of the feature vectors. Equally, it may suffice to obtain such second-order features for only a sub-set of the first-order features, such as, for example, the mean value for the first, third and fifth features taken over a chosen range of feature vectors.

The set of features, in effect an extended feature vector comprising first- and second-order features, obtained using the method according to the invention can be stored independently of the audio signal for which it was derived, or it can be stored together with the audio input signal, for example in the form of metadata.

A music track or song can then be described accurately by the set of features derived for it according to the method described above. Such feature sets make it possible to carry out, with a high degree of accuracy, classification and comparison for pieces of music.

For example, if feature sets or extended feature vectors for a number of audio signals of similar nature, such as those belonging to a single class—e.g. "baroque"—are derived, these feature sets can then be used to build a model for the class "baroque". Such a model might be, for example, a Gaussian multivariate model with each class having its own mean vector and its own covariance matrix in a feature space occupied by extended feature vectors. Any number of groups or classes can be trained. For music audio input signals, such a class might be defined broadly, for example "reggae", "country", "classic", etc. Equally, the models can be more narrow or refined, for example "80s disco", "20s jazz", "finger-style guitar", etc., and are trained with suitably representative collections of audio input signals.

To ensure optimal classification results, the dimensionality of the model space is kept as low as possible, i.e. by choosing a minimum number of first-order features, while choosing these first-order features to give the best possible discrimination between classes. Known methods of feature ranking and dimensionality reduction can be applied to determine the best first-order features to choose. Once a model for a group or class is trained using a number of audio signals known to belong to that group or class, an "unknown" audio signal can be tested to determine whether it belongs to that class by simply checking whether the set of features for that audio input signal fits the model to within a certain degree of similarity.

Therefore, a method of classifying an audio input signal into a group preferably comprises deriving a set of features for the input audio signal and determining, on the basis of the set of features, the probability that the audio input signal corresponds to any of a number of groups or classes, where each group or class corresponds to a particular audio class.

A corresponding classifying system for classifying an audio input signal into one or more groups might comprise a system for deriving a set of features of the audio input signal, and a probability determination unit for determining, on the basis of the set of features of the audio input signal, the probability that the input audio signal falls within any of a number of groups, where each group corresponds to a particular audio class.

Another application of the method according to the invention might be to compare audio signals, for example, two songs, on the basis of their respective feature sets, in order to determine the level of similarity, if any, between them.

Such a method of comparison therefore preferably comprises the steps of deriving a first set of features for a first audio input signal and deriving a second set of features for a second audio input signal and then calculating a distance between the first and second sets of features in a feature space according to a defined distance measure, before finally determining the degree of similarity between the first and second audio signals based on the calculated distance. The distance measure used might be, for example, a Euclidean distance between certain points in feature space.

A corresponding comparison system for comparing audio input signals to determine a degree of similarity between them might comprise a system for deriving a first set of features for a first audio input signal and a system for deriving a second set of features for a second audio input signal, as well as a comparator unit for calculating a distance between the first and second sets of features in a feature space according to a defined distance measure, and for determining the degree of similarity between the audio input signals on the basis of the calculated distance. Evidently, the system for deriving the first set of features and the system for deriving the second set of features might be one and the same system.

The invention might find application in a variety of audio processing applications. For example, in a preferred embodiment, the classifying system for classifying an audio input signal as described above might be incorporated in an audio processing device. The audio processing device might have access to a music database or collection, organised by class or group, into which the audio input signal is classified. Another type of audio processing device might comprise a music query system for choosing one or more music data files from a particular group or class of music in the database. A user of such a device can therefore easily put together a collection of songs for entertainment purposes, for example for a themed music event. A user availing of a music database where songs have been classified according to genre and decade might specify that a number of songs belonging to a category such as "pop, 1980s" be retrieved from the database. Another useful application of such an audio processing device would be to assemble a collection of songs having a certain mood or rhythm suitable for accompanying an exercise workout, vacation slide-show presentation, etc. A further useful application of this invention might be to search a music database for one or music tracks similar to a known music track.

The systems according to the invention for deriving feature sets, classifying audio input signals, and comparing input signals can be realised in a straightforward manner as a computer program or programs. All components for deriving feature sets of an input signal such as feature extraction unit, correlation value generation unit, feature set compilation unit, etc. can be realised in the form of computer program modules. Any required software or algorithms might be encoded on a processor of a hardware device, so that an existing hardware device might be adapted to benefit from the features of the invention. Alternatively, the components for deriving feature sets of an audio input signal can equally be realised at least partially using hardware modules, so that the invention can be applied to digital and/or analog audio input signals.

Other objects and features of the present invention will become apparent from the following detailed descriptions considered in conjunction with the accompanying drawing. It is to be understood, however, that the drawings are designed solely for the purposes of illustration and not as a definition of the limits of the invention.

FIG. 1 is an abstract representation of the relationship between time-frames and features extracted from an input audio signal;

FIG. 2*a* is a schematic block diagram of a system for deriving a set of features from an audio input signal according to a first embodiment of the invention;

FIG. 2*b* is a schematic block diagram of a system for deriving a set of features from an audio input signal according to a second embodiment of the invention;

In the diagrams, like numbers refer to like objects throughout.

Figure 1:
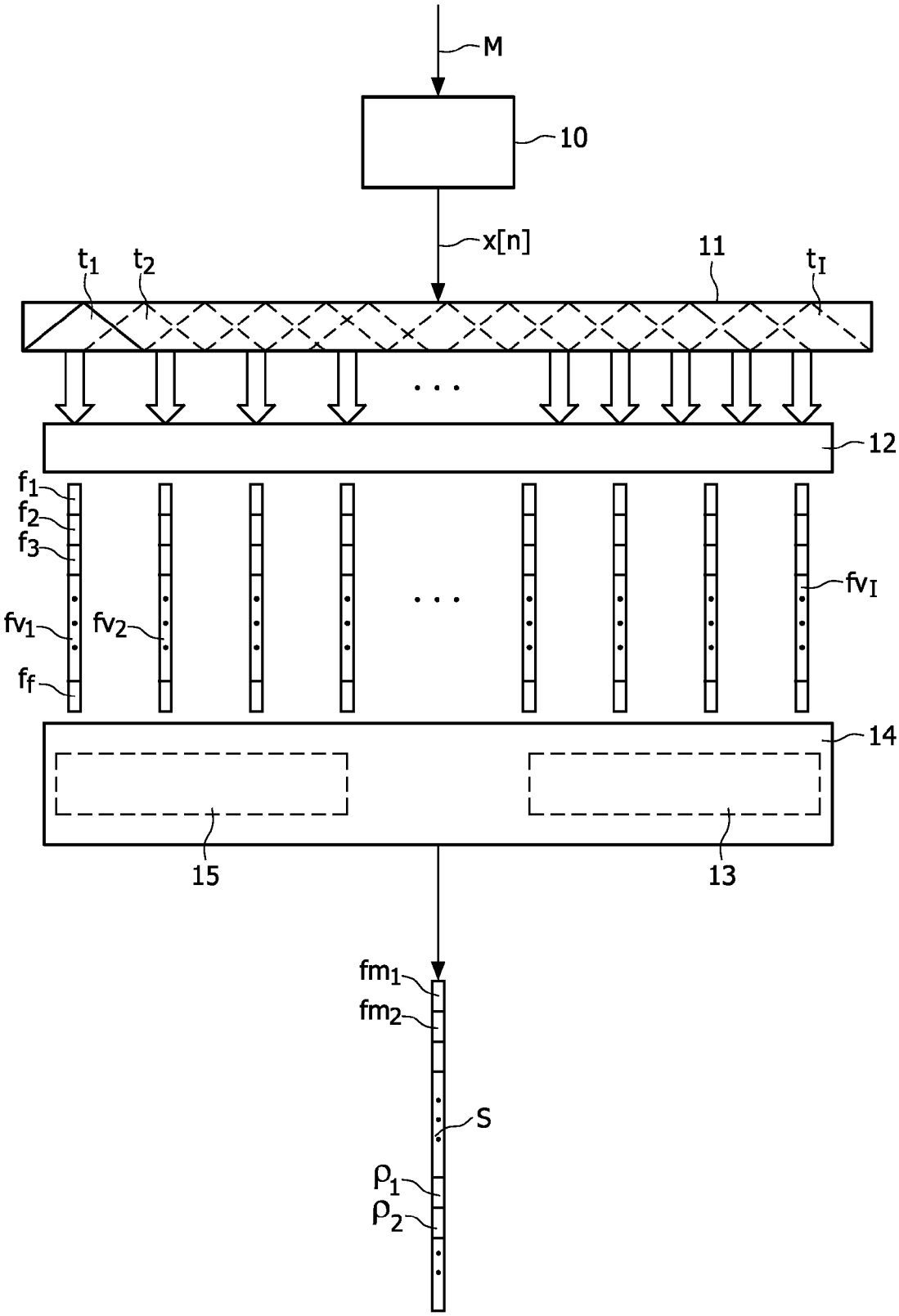

To simplify understanding of the methods pursuant to the invention and described below, FIG. 1 gives an abstract representation between time-frames $t_1, t_2, \ldots, t_I$ or sections of an input signal M and the set of features S ultimately derived for that input signal M.

The input signal for which a set of features is to be derived could originate from any appropriate source, and could be a sampled analog signal, an audio-coded signal such as an MP3 or AAC file, etc. In this diagram, the audio input M is first digitized in a suitable digitising unit 10 which outputs a series of analysis windows from the digitised stream of samples. An analysis window can be of a certain duration, for example, 743 ms. A windowing unit 11 further sub-divides an analysis window into a total of I overlapping time-frames $t_1, t_2, \ldots, t_I$, so that each time frame $t_1, t_2, \ldots, t_I$ covers a certain number of the samples of the audio input signal M. Consecutive analysis windows can be chosen so that they overlap by several tiles, which is not shown in the diagram. Alternatively, a single, sufficiently wide analysis window can be used from which to extract the features.

For each of these time-frames $t_1, t_2, \ldots, t_I$, a number of first-order features $f_1, f_2, \ldots, f_f$ is extracted in a feature extraction unit 12. These first-order features $f_1, f_2, \ldots, f_f$ might be computed from a time-domain or frequency domain signal representation, and can vary as a function of time and/or frequency, as will be explained in greater detail below. Each group of first-order features $f_1, f_2, \ldots, f_f$ for a time/frequency tile or time-frame is referred to as a first-order feature vector, so that feature vectors $fv_1, fv_2, \ldots, fv_I$ are extracted for the tiles $t_1, t_2, \ldots, t_I$.

In a correlation value generation unit 13, correlation values are generated for certain pairs of first-order features $f_1, f_2, \ldots, f_f$. The pairs of features may be taken from single feature vectors $fv_1, fv_2, \ldots, fv_I$ or from across different feature vectors $fv_1, fv_2, \ldots, fv_I$. For example, a correlation might be computed for the pair of features $(fv_1[i], fv_2[i])$, taken from different feature vectors, or for the pair of features $(fv_1[j], fv_1[k])$ from the same feature vector.

In a feature processing block 15, one or more derivatives $fm_1, fm_2, \ldots, fm_f$ of the first-order features $fv_1, fv_2, \ldots, fv_I$, e.g. a mean value, an average value or set of average values can be computed across the first-order feature vectors $fv_1, fv_2, \ldots, fv_I$.

The correlation values generated in the correlation value generation unit 13 are combined in a feature set compilation unit 14 with the derivative(s) $fm_1, fm_2, \ldots, fm_f$ of the first-order features $f_1, f_2, \ldots, f_f$ computed in the feature processing block 15 to give a set of features S for the audio input signal M. Such a feature set S can be derived for every analysis window, and used to compute an average feature set for the entire audio input signal M, which might then be stored as metadata in an audio file, together with the audio signal, or in a separate metadata database, as required.

Figure 2A:
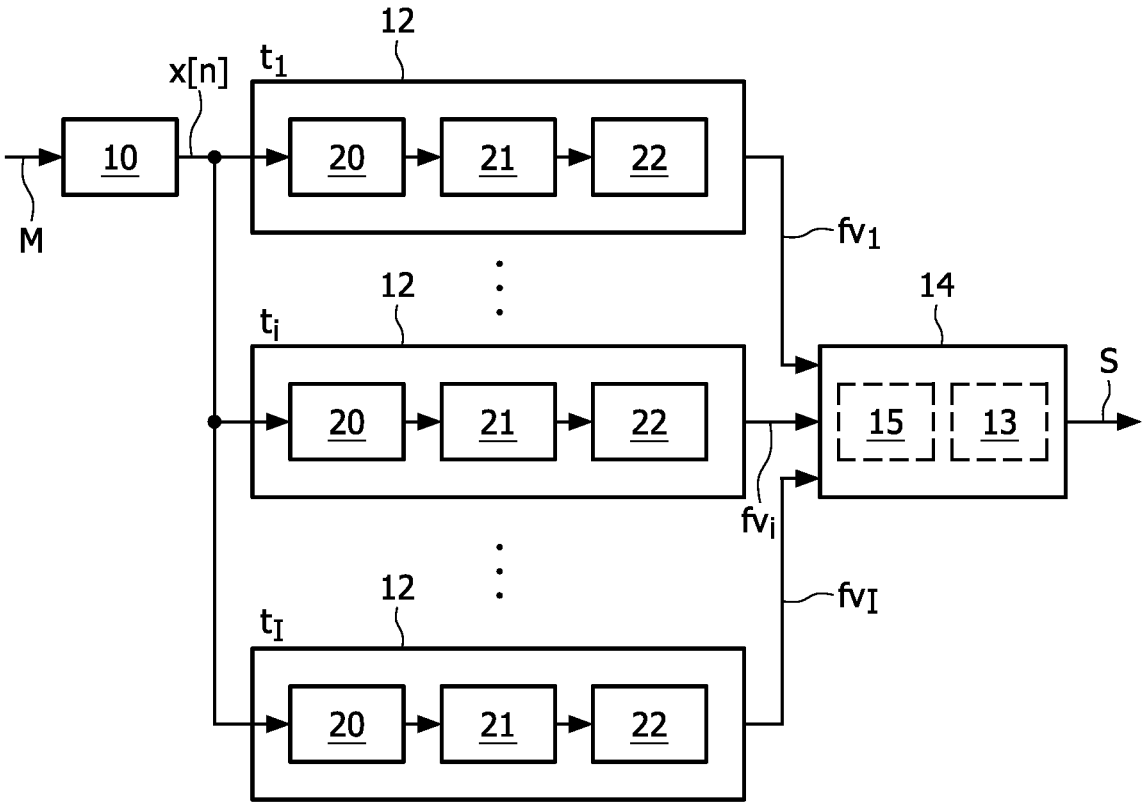

In FIG. 2*a*, the steps of deriving a set of features S in the time domain for an audio input signal x(n) are explained in more detail. The audio input signal M is first digitized in a digitization block 10 to give a sampled signal:

$$x[n] = x\left(\frac{n}{f_s}\right) \tag{1}$$

Subsequently, the sampled input signal x[n] is windowed in a windowing block 20 to yield a group of windowed samples $x_i[n]$ of size N and hop-size H for a tile in the time-domain using a window w[n]:

$$x_i[n] = \begin{cases} w[n]x[n+Hi] & \text{for } 0 \le n < N \\ 0 & \text{otherwise} \end{cases} \tag{2}$$

Each group of samples $x_i[n]$, corresponding to a time-frame $t_i$ in the diagram, is then transformed to the frequency domain, in this case by taking the Fast Fourier Transform (FFT):

$$X_i[k] = \sum_n x_i[n]\exp\{-2\pi jnk/N\} \tag{3}$$

Subsequently, in a log power calculation unit 21, values for log-domain sub-band power P[b], are computed for a set of frequency sub-bands, using a filter kernel $W_b[k]$ for each frequency sub-band b:

$$P_i[b] = 10\log_{10}\left(\sum_k X_i[k]X_i^*[k]W_b[k]\right) \tag{4}$$

Finally, in a coefficient calculation unit 22, the Mel-frequency cepstral coefficients ($MFCC_s$) for each time-frame are obtained by the direct cosine transform (DCT) of each sub-band power value P[b] over B power sub-bands:

$$MFCC_i[m] = \sqrt{\frac{1}{B}}\sum_b P_i[b]\cos\left(\frac{\pi(2b+1)m}{2B}\right) \tag{5}$$

The windowing unit 20, log power calculation unit 21 and coefficient calculation unit 22 taken together give a feature extraction unit 12. Such a feature extraction unit 12 is used to calculate the features $f_1, f_2, \ldots, f_f$ for each of a number of analysis windows of the input signal M. The feature extraction unit 12 will generally comprise a number of algorithms realised in software, perhaps combined as a software package. Evidently, a single feature extraction unit 12 can be used to process each analysis window separately, or a number of separate feature extraction units 12 can be implemented so that several analysis windows can be processed simultaneously.

Once a certain set of time-frames I has been processed as described above, a second-order feature can be computed (over the analysis frame of I sub-frames) that consists of the (normalized) correlation coefficient between certain frame-based features. This takes place in a correlation value generation unit 13. For example, the correlation between the y-th and z-th MFCC coefficient across time is given as follows by equation (6):

$$\rho(y, z) = \frac{\sum_i (MFCC_i[y]-\mu_y)(MFCC_i[z]-\mu_z)}{\sqrt{\sum_i (MFCC_i[y]-\mu_y)(MFCC_i[y]-\mu_y)\sum_i (MFCC_i[z]-\mu_z)(MFCC_i[z]-\mu_z)}}$$

where $\mu_y$ and $\mu_z$ are the means (across I) of $MFCC_i[y]$ and $MFCC_i[z]$ respectively. Adjustment of each coefficient by subtracting the mean gives a Pearson's correlation coefficient as second-order feature, which is in effect a measure the strength of the linear relationship between two variables, in this case the two coefficients $MFCC_i[y]$ and $MFCC_i[z]$.

The correlation value ρ(y,z) calculated above can then be used as a contribution to a set of features S. Other elements of the set of features S can be derivatives of the first-order feature vectors $fv_1, fv_2, \ldots, fv_I$ of a time-frame, calculated in a feature processing block 15, for example mean or average values of the first few features $f_1, f_2, \ldots, f_f$ of each feature vector $fv_1, fv_2, \ldots, fv_I$, taken over the entire range of feature vectors $fv_1, fv_2, \ldots, fv_I$.

Such derivatives of the first-order feature vectors $fv_1, fv_2, \ldots, fv_I$ are combined with the correlation values in a feature combination unit 14 to give the set of features S as output. The set of features S can be stored with or separately from the audio input signal M in a file, or can be further processed before storing. Thereafter, the set of features S can be used, for instance, to classify the audio input signal M, to compare the audio input signal M with another audio signal, or to characterize the audio input signal M.

Figure 2B:
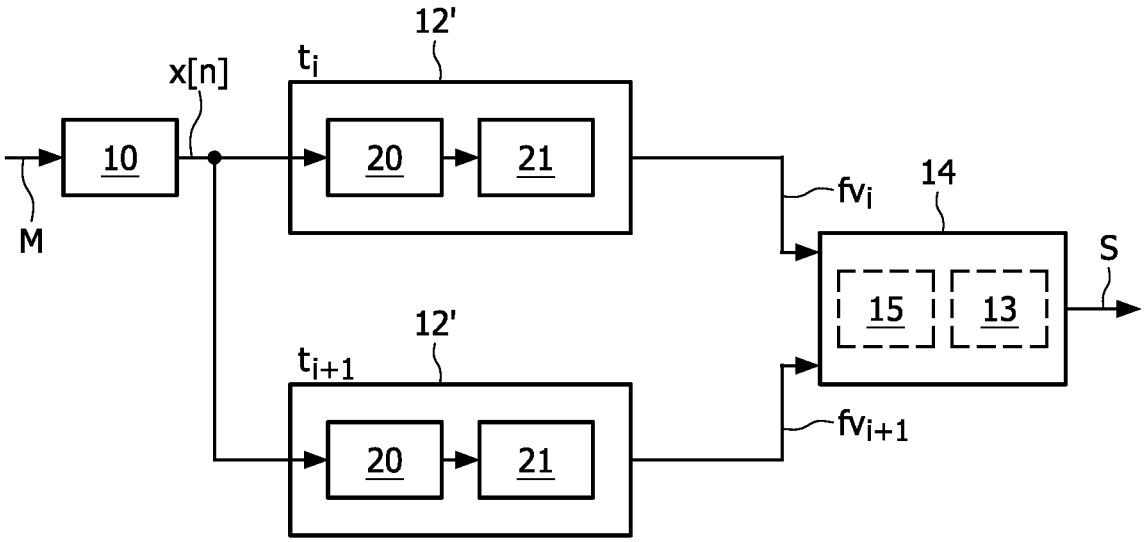

FIG. 2*b* shows a block diagram of a second embodiment of the invention in which the features are extracted in the frequency domain for a total B of discrete frequency sub-bands. The first few stages, up to and including the computation of the log sub-band power values are effectively the same as those already described above under FIG. 2*a*. In this realisation, however, the values of power for each frequency sub-band are directly used as features, so that a feature vector $fv_i$, $fv_{i+1}$, in this case comprises the values of power for each frequency sub-band over the range of frequency sub-bands, as given in equation (4). Therefore, the feature extraction unit 12' requires only a windowing unit 20 and log power calculation unit 21.

Calculation of a correlation value or second-order feature in this case is carried out in a correlation value generation unit 13 for consecutive pairs of time-frames $t_i$, $t_{i+1}$, i.e. over pairs of feature vectors $f_i$, $f_{i+1}$. Again, each feature in each feature vector $f_i$, $f_{i+1}$, is first adjusted by subtracting from it a mean value $\mu_{Pi}$, $\mu_{Pi+1}$. In this case, for example, $\mu_{Pi}$ is calculated by summing all the elements of the feature vector $f_i$ and dividing the sum by the total number of frequency sub-bands, B. The correlation value $\rho(P_i, P_{i+1})$ for a pair of feature vectors $f_i$, $f_{i+1}$, is computed as follows:

$$\rho(P_i, P_{i+1}) = \frac{\sum_b (P_i[b]-\mu_{Pi})(P_{i+1}[b]-\mu_{Pi+1})}{\sqrt{\sum_b (P_i[b]-\mu_{Pi})(P_i[b]-\mu_{Pi})\sum_b (P_{i+1}[b]-\mu_{Pi+1})(P_{i+1}[b]-\mu_{Pi+1})}} \tag{7}$$

The correlation values for feature vector pairs can be combined in a feature combination unit 14, as described under FIG. 2*a* above, with derivatives of the first-order features calculated in a feature processing block 15 to give as output the set of features S. Again, as already described above, the set of features S can be stored with or separately from the audio input signal in a file, or can be further processed before storing.

Figure 3:
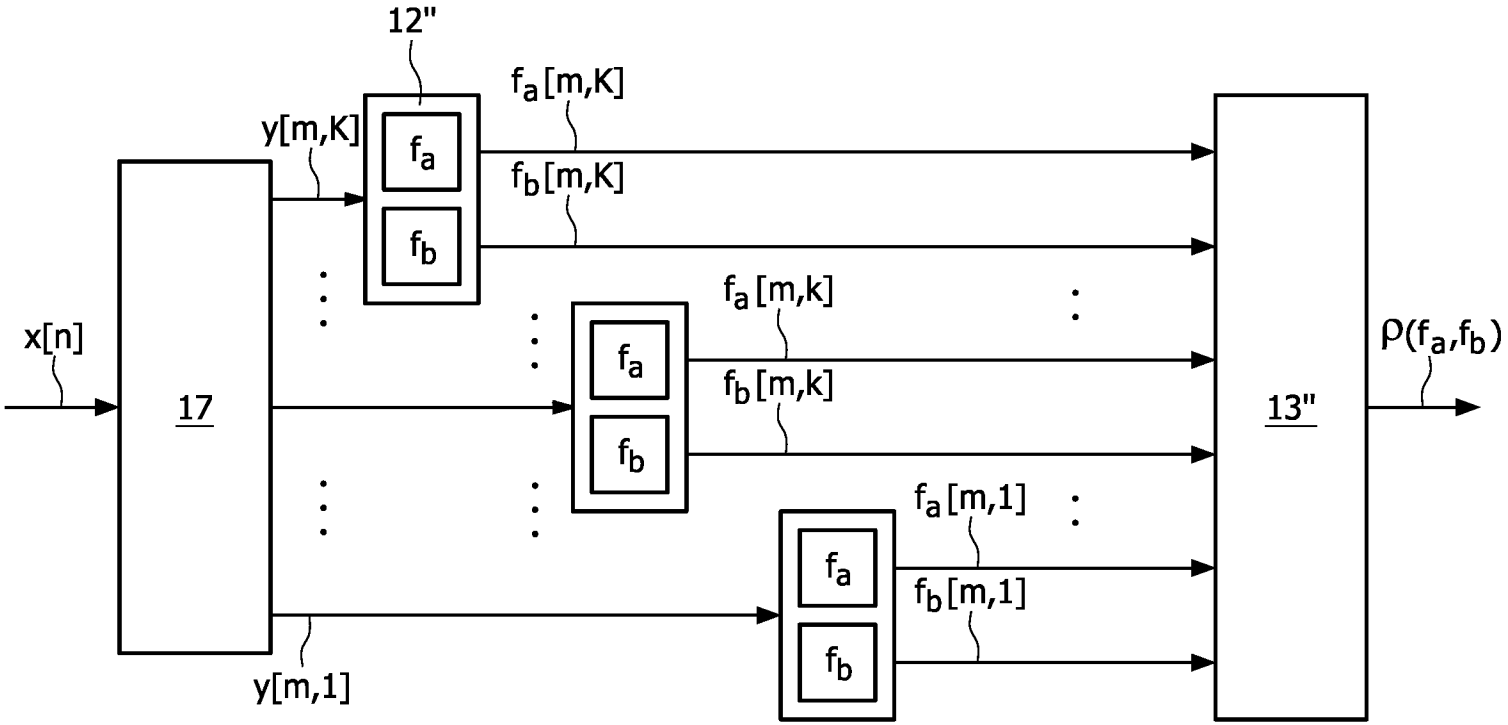
FIG. 3 is a schematic block diagram of a system for deriving a set of features from an audio input signal according to a third embodiment of the invention.

FIG. 3 illustrates a third embodiment of the invention where features extracted from an input signal contain both time-domain and frequency-domain information. Here, the audio input signal x[n] is a sampled signal. Each sample is input to a filter-bank 17 comprising a total of K filters. The output of the filter-bank 17 for an input sample x[n] is, therefore, a sequence of values y[m, k], where $1 \leqq k \leqq K$. Each k index represents a different frequency band of the filter-bank 17, whereas each m index represents time, i.e. the sampling rate of the filter-bank 17. For every filter-bank output y[m, k], features $f_a[m, k]$, $f_b[m, k]$ are calculated. The feature type $f_a[m, k]$ in this case can be the power spectral value of its input y[m, k], while the feature type $f_b[m, k]$ is the power spectral value calculated for the previous sample. Pairs of these features $f_a[m, k]$, $f_b[m, k]$ can be correlated across the range of frequency sub-bands, i.e. for values of $1 \leqq k \leqq K$, to give correlation values $\rho(f_a, f_b)$:

$$\rho(f_a, f_b) = \frac{\sum_m \sum_k (f_a[m, k] - \mu_{f_a})(f_b[m, k] - \mu_{f_b})}{\sqrt{\left(\sum_m \sum_k (f_a[m, k] - \mu_{f_a})^2\right)\left(\sum_m \sum_k (f_b[m, k] - \mu_{f_b})^2\right)}} \quad (8)$$

Figure 4:
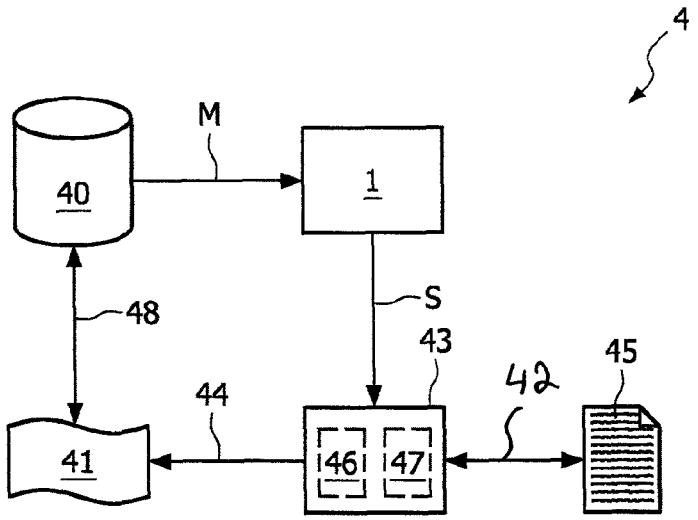
FIG. 4 is a schematic block diagram of a system for classifying an audio signal.

In FIG. 4, a simplified block diagram of a system 4 for classification of an audio signal M is shown. Here, the audio signal M is retrieved from a storage medium 40, for example a hard-disk, CD, DVD, music database, etc. In a first stage, a set of features S is derived for the audio signal M using a system 1 for feature set derivation. The resulting set of features S is forwarded to a probability determination unit 43. This probability determination unit 43 is also supplied with class feature information 42 from a data source 45, describing the feature positions, in feature space, of the classes to which the audio signal can possibly be assigned.

In the probability determination unit 43, a distance measurement unit 46 measures, for example, the Euclidean distances in feature space between the features of the set of features S and the features supplied by the class feature information 42. A decision making unit 47 decides, on the basis of the measurements, to which class(es), if any, the set of features S, and therefore the audio signal M, can be assigned.

In the event of a successful classification, suitable information 44 can be stored in a metadata file 41 associated, by a suitable link 48, with the audio signal M. The information 44, or metadata, might comprise the set of features S of the audio signal M as well as the class to which the audio signal M has been assigned, along with, for instance, a measure of the degree to which this audio signal M belongs to that class.

Figure 5:
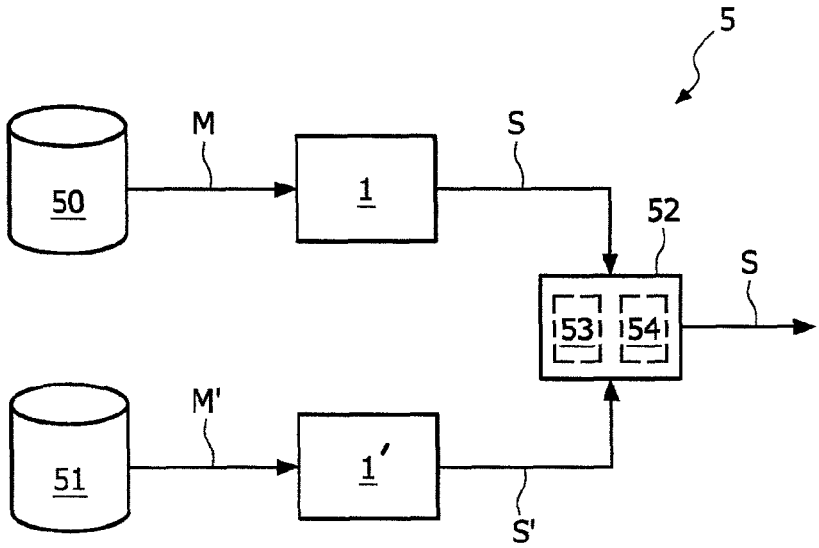
FIG. 5 is a schematic block diagram of a system for comparing audio signals.

FIG. 5 shows a simplified block diagram of a system 5 for comparing audio signals M, M' such as can be retrieved from databases 50, 51. With the aid of two systems 1, 1' for feature set derivation, feature set S and feature set S' are derived for music signal M and music signal M' respectively. Merely for the sake of simplicity, the diagram shows two separate systems 1, 1' for feature set derivation. Naturally, a single such system could be implemented, by simply performing the derivation for one audio signal M and then for the other audio signal M'.

The feature sets S, S' are input to a comparator unit 52. In this comparator unit 52, the feature sets S, S' are analysed in a distance analysis unit 53 to determine the distances in feature space between the individual features of the feature sets S, S'. The result is forwarded to a decision making unit 54, which uses the result of the distance analysis unit 53 to decide whether or not the two audio signals M, M' are sufficiently similar to be deemed to belong to the same group. The result arrived at by the decision making unit 54 is output as a suitable signal 55, which might be a simple yes/no type of result, or a more informative judgement as to the similarity, or lack of similarity, between the two audio signals M, M'.

Although the present invention has been disclosed in the form of preferred embodiments and variations thereon, it will be understood that numerous additional modifications and variations could be made thereto without departing from the scope of the invention. For example, the method for deriving a feature set for a music signal could be used in a audio processing device which characterises music tracks, with possible applications for generation of descriptive metadata for the music tracks. Furthermore, the invention is not limited to using the methods of analysis described, but may apply any suitable analytical method.

For the sake of clarity, it is also to be understood that the use of "a" or "an" throughout this application does not exclude a plurality, and "comprising" does not exclude other steps or elements. A "unit" or "module" may comprise a number of blocks or devices, as appropriate, unless explicitly described as a single entity.

The invention claimed is:

1. A method of deriving a set of features of an audio input signal the method comprising the acts of:

extracting first-order features from a plurality of sections of the audio input signal to form first-order feature vectors, wherein a first first-order feature vector includes first-order features associated with a first section of the plurality of sections of the audio input signal;

identifying by a processor the first-order features of the audio input signal;

generating correlation values from a pair of the first-order features associated with the first section and included in the first first-order feature vector; and compiling the set of features for the audio input signal using the correlation values.

2. The method according to claim 1, wherein a first-order feature of the pair of the first-order features used in the generating act is adjusted by a mean of corresponding first-order features prior to the generating act.

3. A method of classifying an audio input signal into a group and determining, based on the set of features of the audio input signal, a probability that the audio input signal falls within any of a number of groups, where each group represents a particular audio class, wherein the set features has been derived using the method according to claim 1.

4. A method of comparing audio input signals to determine a degree of similarity between the audio input signals, wherein the method comprises the acts of:

deriving a first set of features for a first audio input signal;

deriving a second set of features or a second audio input signal;

calculating a distance between the first and second sets of features in a feature space according to a defined distance measure;

determining the degree of similarity between the first and second audio input signals based on the calculated distance, wherein the first and second set of features have been derived using a method according to claim 1.

5. The method of claim 1, further comprising the act of computing a derivative of at least a number the first-order features, wherein the compiling act includes combining a number of the correlation values with the derivative to compile the set of features.

6. A system for deriving a set of features of an audio input signal, the system comprising a processor configured to:

extract first-order features from a plurality of sections of the audio input signal to form first-order feature vectors, wherein a first first-order feature vector includes first-order features associated with a first section of the plurality of sections of the audio input signal;

identify the first-order features of the audio input signal;

generate correlation values from a pair of the first-order features associated with the first section and included in the first first-order feature vector; and compile the set of features for the audio input signal using the correlation values to derive the set of features.

7. A classifying system for classifying an audio input signal into a group, comprising a processor configured to:

extract first-order features from a plurality of sections of the audio input signal to form first-order feature vectors, wherein a first first-order feature vector includes first-order features associated with a first section of the plurality of sections of the audio input signal;

identify the first-order features of the audio input signal;

generate correlation values from a pair of the first-order features associated with the first section and included in the first first-order feature vector;

compile the set of features for the audio input signal using the correlation values with the derivative to derive a set of features; and determine based on the set of features of the audio input signal, probability that the audio input signal falls within any of a number of groups, where each group represents a particular audio class.

8. An audio processing device comprising the classifying system according to claim 7.

9. A comparison system for comparing audio input signals to determine a degree of similarity between the audio input signals, the comparison system comprising a processor configured to:

extract first-order features from a plurality of sections of the audio input signal to form first-order feature vectors, wherein a first first-order feature vector includes first-order features associated with a first section of the plurality of sections of the audio input signal;

identify the first-order features of the audio input signal;

generate correlation values from a pair of the first-order features associated with the first section and included in the first first-order feature vector; and compile the set of features for the audio input signal using the correlation values with the derivative to derive a set of features;

calculate a distance between a first set and a second set of the set of features in a feature space according to a defined distance measure; and determine the degree of similarity between the audio input signals based on the calculated distance.

10. A tangible computer readable medium embodying non-transitory computer instructions which, when executed by a processor, configure the processor to:

extracting first-order features from a plurality of sections of the audio input signal to form first-order feature vectors, wherein a first first-order feature vector includes first-order features associated with a first section of the plurality of sections of the audio input signal;

identify the first-order features of the audio input signal;

generate correlation values from a pair of the first-order features associated with the first section and included in the first first-order feature vector; and compile the set of features for the audio input signal using the correlation values with the derivative to derive a set of features of the audio input signal.

* * * * *